United States Patent [19]

Patel et al.

[11] Patent Number: 4,632,895

[45] Date of Patent: Dec. 30, 1986

[54] DIFFUSION OR SUBLIMATION TRANSFER IMAGING SYSTEM

[75] Inventors: Ranjana C. Patel, Bishops Stortford; John H. A. Stibbard, Harlow; Michael G. Fisher, Epping; Terence W. Baldock, Harlow, all of Great Britain

[73] Assignee: Minnesota Mining and Manufacturing Company, St. Paul, Minn.

[21] Appl. No.: 767,741

[22] Filed: Aug. 21, 1985

[30] Foreign Application Priority Data

Aug. 23, 1984 [GB] . United Kingdom ..... 8421398
Aug. 23, 1984 [GB] United Kingdom ..... 8421400

[51] Int. Cl.[4] ..... G03C 5/54; G03C 7/02; G03C 1/727

[52] U.S. Cl. ..... 430/201; 430/199; 430/203; 430/211; 430/339; 430/344

[58] Field of Search ..... 430/199, 211, 201, 235, 430/339, 344, 337, 332, 203

[56] References Cited

U.S. PATENT DOCUMENTS

| | | | |
|---|---|---|---|
| 3,595,655 | 7/1971 | Robinson et al. | 430/340 |
| 3,598,583 | 8/1971 | Sprague | 430/344 |
| 3,729,313 | 4/1973 | Smith | 96/27 |
| 3,764,320 | 10/1973 | Sprague | 430/344 |
| 3,982,940 | 9/1976 | Kinjo et al. | 430/199 |
| 4,386,154 | 5/1983 | Smith et al. | 430/344 |
| 4,460,677 | 7/1984 | Smith et al. | 430/344 |

FOREIGN PATENT DOCUMENTS

| | | | |
|---|---|---|---|
| 1378198 | 12/1974 | United Kingdom | 430/235 |

*Primary Examiner*—Richard L. Schilling
*Attorney, Agent, or Firm*—Donald M. Sell; James A. Smith; Mark A. Litman

[57] ABSTRACT

Images can be formed on a receptor sheet by transfer of a dye image. The positive dye image is formed by bleaching of dye with an iodonium ion. The positive dye image is then transferred by sublimation or diffusion onto a receptor sheet.

15 Claims, No Drawings

DIFFUSION OR SUBLIMATION TRANSFER IMAGING SYSTEM

FIELD OF THE INVENTION

This invention relates to a method of forming an image in which a sheet bearing a radiation-sensitive image-forming layer is image-wise exposed to record an image in said layer and thereafter the image-forming components are transferred to a receptor layer or sheet to form a permanent image. In particular, the invention relates to a diffusion or sublimation transfer imaging process employing a radiation-sensitive sheet comprising one or more bleachable dyes.

BACKGROUND OF THE INVENTION

Positive working non-silver systems in which an originally coloured species is decolourised (bleached) in an imagewise manner upon exposure to light have received a considerable amount of attention. A large variety of dyes and activators have been disclosed for such systems, see, for example, J. Kosar, Light Sensitive Systems, page 387, Wiley, New York 1965.

The reaction relies on the fact that the dye absorption is sensitising the dye's own destruction or decolourisation, for example a yellow dyes absorbs blue light; the excited dye thus formed reacts with an activator which releases the species to bleach the dye. Similarly green light would destroy the magenta and red light the cyan dyes.

This dye bleach-out process is thus capable of producing colour images in a simple way. However, in spite of its apparent simplicity, the bleach-out process poses a number of problems. In particular, the purity of the whites in the final image leaves much to be desired, image stability may not be good and a fixing step may be required to stabilise the image.

One imaging system discloses a radiation-sensitive element capable of recording an image upon image-wise exposure to radiation of selected wavelength, the element comprising, as the image-forming components, an effective amount of a bleachable dye in reactive association with an iodonium ion.

The element is capable of recording a positive image simply upon exposure to radiation of selected wavelength; the radiation absorbed by the dye which is in reactive association with an iodonium ion causes the dye to bleach. The dyes are believed to sensitise spectrally the reduction of the iodonium ion through the radiation absorbed by the dyes associated with the iodonium ion. Thereafter the element may be stabilised to fix the image by destruction of the iodonium ion or by separation of the dye relative to the iodonium ion.

The dyes used may be of any colour and any chemical class which is capable of bleaching upon exposure to radiation of selected wavelength in the presence of an iodonium ion.

By a suitable selection of dye an element may be prepared which is sensitive to radiation of a selected wavelength band within the general range 300 to 1100 nm, the particular wavelength and the width of the band depending upon the absorption characteristics of the dye. In general, where a dye has more than one absorption peak it is the wavelength corresponding to the longest wavelength peak at which one would choose to irradiate the element.

Elements intended for the production of images from radiation in the visible region (400 to 700 nm) will contain dyes which will bleach from a coloured to a substantially colourless or very pale state. In practice, such bleachable dyes will undergo a change such that the transmission optical density at the $\lambda_{max}$ will drop from 1.0 or more to less than 0.09, preferably less than 0.05. The dyes will generally be coated on the support to provide an optical density of about 3.0 or more.

In the case of elements sensitive to ultraviolet radiation (300 to 400 nm) the dyes will not normally be coloured to the eye and there may be no visible change upon exposure to ultraviolet radiation and bleaching. The image-wise exposed elements may be used as masks for further ultraviolet exposure after fixing.

Infrared sensitive elements contain dyes having an absorption peak in the wavelength range 700 to 1100 nm. These dyes may also have absorption peaks in the visible region before and/or after bleaching. Thus, as well as providing a means for obtaining masks for subsequent infrared exposure in a similar manner to the ultraviolet masks, infrared sensitive elements may record a visible image upon image-wise exposure to infrared radiation.

Exposure may be achieved with a wide variety of sources including incandescent, gas discharge and laser sources. For laser scanning applications the laser beam may need to be focussed in order to achieve sufficient exposure.

The dyes used may be anionic, cationic or neutral. Anionic dyes give very good photosensitisation which is believed to be due to an intimate reactive association between the negatively charged dye and the positively charged iodonium ion. Also anionic dyes may readily be mordanted to cationic polymer binders and it is relatively simple to remove surplus iodonium ions in an aqueous bath in a fixing step if the mordanting polymer is cationic. However, neutral dyes also give good results and are preferred over cationic dyes for overall photosensitivity. Cationic dyes are least preferred since it is more difficult to achieve intimate reactive association between the positively charged dye and iodonium ion, and selective removal of iodonium ion after imaging is more difficult.

The bleachable dyes may be generically referred to as polymethine dyes which term characterises dyes having at least one electron donor and one electron acceptor group linked by methine groups or aza analogues. The dyes have an oxidation potential between 0 and +1 volt, preferably between +0.2 and +0.8 volt. The bleachable dyes may be selected from a wide range of known classes of dyes including allopolar cyanine dye bases, complex cyanine, hemicyanine, merocyanine, azine, oxonol, streptocyanine and styryl.

The dye and iodonium system has its greatest sensitivity at the $\lambda_{max}$ of the longest wavelength absorbance peak. Generally, it is necessary to irradiate the system with radiation of wavelength in the vicinity of this $\lambda_{max}$ for bleaching to occur. Thus, a combination of coloured dyes may be used, e.g. yellow, magenta and cyan, in the same or different layers in an element and these can be selectively bleached by appropriate visible radiation to form a full colour image. Monochromatic or polychromatic images may be produced using the photosensitive materials with relatively short exposure times in daylight or sunlight or even artificial sources of light (e.g. fluorescent lamps or laser beams). The exposure time, for adequate results, for example when using an 0.5 kW tungsten lamp at a distance of 0.7 m, may be between 1 second to 10 minutes.

The iodonium salts used in the imaging system are compounds consisting of a cation wherein a positively charged iodine atom bears two covalently bonded carbon atoms, and any anion. Preferably the acid from which the anion is derived has a pKa <5. The preferred compounds are diaryl, aryl/heteroaryl or diheteroaryl iodonium salts in which the carbon-to-iodine bonds are from aryl or heteroaryl groups. Aliphatic iodonium salts are not normally thermally stable at temperatures above 0° C. However, stabilised alkyl phenyl iodonium salts such as those disclosed in *Chem. Lett.* 1982, 65–6 are stable at ambient temperatures and may be used.

The bleachable dye and iodonium salt are in reactive association on the support. Reactive association is defined as such physical proximity between the compounds as to enable a chemical reaction to take place between them upon exposure to light. In practice, the dye and iodonium salt are in the same layer or in adjacent layers on the support.

In general, the weight ratio of bleachable dye to iodonium salt in the element is in the range from 1:1 to 1:50, preferably in the range from 1:2 to 1:10.

The bleachable dye and iodonium salt may be applied to the support in a binder. Suitable binders are transparent or translucent, are generally colourless and include natural polymers, synthetic resins, polymers and copolymers, and other film forming media. The binders may range from thermoplastic to highly cross-linked, and may be coated from aqueous or organic solvents or emulsions.

Suitable supports include transparent film, e.g. polyester, paper e.g. baryta-coated photographic paper, and metallised film. Opaque vesicular polyester films are also useful.

The fixing of the radiation-sensitive elements may be effected by destruction of the iodonium ion by disrupting at least one of the carbon-to-iodine bonds since the resulting monoaryl iodine compound will not react with the dye. The conversion of the iodonium salt to its non-radiation sensitive form can be effected in a variety of fashions. Introduction of ammonia and amines in reactive association with the iodonium ion, or a reaction caused on heating, or UV irradiation of a nucleophilic anion such as $I^{\ominus}$, $Br^{\ominus}$, $Cl^{\ominus}$, $BAr_4^{\ominus}$ (tetra-arylboronide), $ArO^{\ominus}$ (e.g. phenoxide), or $4NO_2C_6H_4CO_2^{\ominus}$, with the iodonium ion, will effect the conversion.

An alternative method of achieving post-imaging stabilisation or fixing is to remove the iodonium ion from reactive association with the dye by washing with an appropriate solvent. For example, in the case of elements using mordanted oxonol dyes and water soluble iodonium salts formulated in gelatin, after imaging, the iodonium salt is simply removed by an aqueous wash, which leaves the immobilised dye in the binder. The dye stability to light is then equivalent to that of the dye alone. An element in which the dye and iodonium salt is formulated in polyvinylpyridine may be treated with aliphatic ketones to remove the iodonium salt and leave the dye in the binder.

The elements may be used as transparencies for use with overhead projectors, for making enlarged or duplicate copies of colour slides and for related graphics or printing applications, such as pre-press colour proofing materials.

Dye diffusion transfer systems are known and are becoming increasingly important in colour photography (see C. C. Van de Sande in Angew Chem. 1983, 22, 191–209). These systems allow "rapid access" colour images without a complicated processing sequence. The construction of these colour materials may be donor-receptor type (e.g. Ektaflex commercially available from Kodak) integral peel-apart type (e.g. Polaroid, E. H. Land, H. G. Rogers, V. K. Walworth in J. Sturge Nebelette's Handbook of Photography and Reprography, 7th Ed. 1977, Chapter 12), or integral single sheet type (e.g. Photog. Sci. and Eng., 1976, 20, 155). Silver halide diffusion transfer systems are also known (e.g. E. H. Land. Photog. Sci. and Eng., 1977, 21, 225). Examples of diffusion transfer fixing in non-silver, dye-forming reactions employing solvent application to effect the transfer are disclosed in U.S. Pat. No. 3,598,583. This patent also describes a full-colour imaging element, applicable for preparation of colour proofs, fixed by transfer of dye precursors in register to a receptor. Other examples of non-silver diffusion transfer imaging systems are disclosed in British Patent Specification Nos. 1 057 703, 1 355 618 and 1,378,898. The latter two Patents also disclose transfer of dye images under the influence of dry heat.

It has now been found that certain dyes which are bleachable upon exposure to radiation in the presence of iodonium ion are susceptible to diffusion or sublimation transfer and this property may be utilised to separate such dyes from the iodonium ion and produce a clean, stable image by transfer from a radiation-sensitive layer to a receptor layer or separate receptor element.

BRIEF SUMMARY OF THE INVENTION

According to the present invention there is provided a process for forming an image which comprises image-wise exposing to radiation of selected wavelength a carrier element comprising, as image forming components, in one or more imaging layers coated on a support a bleachable dye in reactive association with iodonium ion thereby bleaching the dye in exposed areas to form a positive image, and thereafter transferring the positive dye image to a receptor which is either a receptor layer present on the carrier or a separate receptor element by (i) heating the carrier element to a sufficient temperature to allow the dye image to sublime to the receptor thereby forming an image on the receptor, or (ii) providing a liquid medium between the positive dye image and receptor for a sufficient time to allow transfer of the dye image to the receptor.

The process of the invention provides stable dye images, optionally full colour images, of high quality with low background fog. The imaging system does not require the presence of silver halide.

DESCRIPTION OF THE PREFERRED EMBODIMENTS

In accordance with one aspect of the invention the bleachable dye is soluble in a diffusion transfer liquid and after image-wise exposure the positive dye image is transferred to a separate receptor or a receptor layer of the element by providing a transfer liquid between the dye image and receptor thereby causing diffusion transfer of the image to the receptor. This semi-dry process allows production of images within a few minutes and the background fog levels are substantially reduced giving much cleaner images. Typically, fog levels are reduced from 0.15 to less than 0.05. This technique may be used to form full colour images of high quality suitable for use in pre-press colour proofing.

The diffusion transfer process utilises dyes which are soluble in a liquid, preferably an aqueous solvent. It is preferred that the bleached products of the dye and iodonium ion are non-diffusing. This may normally be achieved by utilising iodonium compounds having a ballasting group. The dye-bleach system comprises a bleachable dye in reactive association with an iodonium ion is disclosed in our copending European Patent Application No. 84301156.0 (Ser. No. 0 120 601).

In accordance with a further aspect of the invention the bleachable dyes are sublimable and after image-wise exposure the carrier element is placed in intimate contact with a receptor and the resulting composite heated for a sufficient time and to a sufficient temperature to allow the dye to sublime across the interface to the receptor thereby forming a laterally reversed positive image on the receptor. Thereafter the carrier element is separated from the receptor.

The sublimation transfer allows the formation of a stable dye image having high colour purity. The process is entirely dry and takes only a few minutes to give colour prints. A single transfer from the carrier element to a receptor results in a mirror image. If a true image, right-reading, is required a double transfer process may be employed transferring the dyes from the carrier element to an intermediate receptor and thereafter transferring the dyes from the intermediate receptor to the final receptor. Alternatively, a true image may be formed by reversing the transparency used for exposure.

The process may be used to achieve a multi-colour print either by sequentially transferring dyes from separate carrier elements or by utilising a carrier element having two or more coloured dyes, e.g. magenta, cyan and yellow, and transferring the dyes simultaneously.

Suitable dyes for use in this system are those which are both bleachable upon exposure to radiation in the presence of an iodonium ion and are sublimable, preferably in the temperature range 80° to 160° C., more preferably 100° to 150° C. In general, the dyes are electrically neutral (i.e. not charged) and have a molecular weight of less than 400, preferably less than 350. The dyes also generally possess a compact or "ball-like" structure; dyes having an elongate structure, e.g. those having long methine chains, do not readily sublime. The dyes are also selected such that they do not fade or undergo a change in colour on sublimation. When more than one dye is employed it is desirable to match the sublimation characteristics of the dyes to ensure an even transfer rate for all the dyes.

Suitable bleachable dyes may be generically referred to as polymethine dyes which term characterises dyes having at least one electron donor and one electron acceptor group linked by methine groups or aza analogues. The dyes have an oxidation potential between 0 and +1 volt, preferably between +0.2 and +0.8 volt. The bleachable dyes may be selected from a wide range of known classes of dyes including allopolar cyanine dye bases, complex cyanine, hemicyanine, merocyanine, azine, oxonol, streptocyanine and styryl.

The dyes useful in the invention are all bleachable dyes; dyes which bleach on exposure when in the presence of an iodonium ion. While any polymethine dye may be transferred by diffusion transfer providing it has a suitable solubility in the diffusion transfer solvent, e.g. more than 10 g/liter in 60% aqueous ethanol, it has been found that cationic and anionic dyes are preferable over neutral dyes because of the possibility of mordanting the dye to a polyanionic or polycationic organic polymer on the surface of the receptor sheet.

In general, suitable dyes for use in the invention will have the structure:

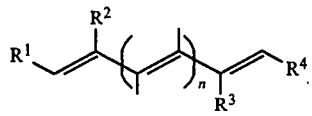

in which:

n is 0, 1 or 2, and $R^1$ to $R^4$ are selected to provide an electron donor moiety at one end of the conjugated chain and an electron acceptor moiety at the other, and may be selected from substituents including hydrogen, halogen, cyano, carboxy, alkoxy, hydroxy, nitro, alkyl, aryl groups or heterocyclic rings any of which may be substituted. The skeletal structure of the groups $R^1$ to $R^4$ generally contain up to 14 atoms selected from C, N, O and S. When the skeletal structure of a $R^1$ to $R^4$ group is in the form of a linear chain there will usually be no more than 6 carbon atoms in the chain. When the skeletal structure is cyclic there will be no more than 7 atoms in any single ring. Cyclic structures may comprise two or more fused rings containing up to 14 atoms. If the skeletal structure of a $R^1$ to $R^4$ group comprises two unfused cyclic groups there will be no more than 3 atoms in the linear chain between the groups. Alternatively, $R^1$ and $R^2$ and/or $R^3$ and $R^4$ may represent the necessary atoms to complete optionally substituted aryl groups or hetreocyclic rings, generally containing up to 14 atoms selected from C, N, O and S and having a structure as defined above.

The conjugated chain is preferably composed of carbon atoms but may include one or more nitrogen atoms providing the conjugation is not disrupted. The free valences on the chain may be satisfied by hydrogen or any substituent of the type used in the cyanine dye art including fused ring systems.

The particular selection of substituents $R^1$ to $R^4$ effects the light absorbance properties of the dye which may be varied to provide absorption peaks ranging from the ultraviolet (300 to 400 nm), near visible (400 to 500 nm), far visible (500 to 700 nm) and infrared (700 to 1100 nm).

Dyes of the above formula are well known particularly in the silver halide photographic art and are the subject of numerous patents. Exemplary dye structures are disclosed in The Theorgy of the Photographic Process, T. H. James, Ed. MacMillan, Editions 3 and 4, and Encyclopaedia of Chemical Technology, Kirk Othmer, 35d Edition, Vol. 18, 1983.

Within the above general structure of dyes are various classes of dye including:

(1) Cyanine dyes of the general formula:

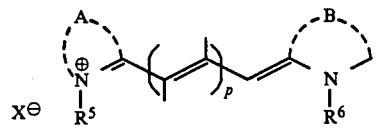

in which:

p is an integer of 0 to 2, $R^5$ and $R^6$ are independently hydrogen or substituents which may be present in conventional cyanine dyes, e.g. alkyl (preferably of 1 to 4 carbon atoms), etc., $X^{\ominus}$ represents an anion, and the groups A and B, which need not necessarily complete a cyclic structure with the methine chain, independently represent alkyl, aryl or heterocyclic groups or the necessary atoms to complete heterocyclic rings which may be the same or different. The skeletal structure of the groups A and B generally contain up to 14 atoms selected from C, N, O and S. When the skeletal structure of A or B is in the form of a linear chain there will usually be no more than 6 carbon atoms in the chain. When the skeletal structure completed by A or B is cyclic there will be no more than 7 atoms in any single ring. Cyclic structures may comprise two or more fused rings containing up to 14 atoms. If the skeletal structure complete by A or B comprises two unfused cyclic groups there will be no more than 3 atoms in the linear chain between the groups.

This class of dyes is very well known particularly in the silver halide photographic art and are the subject of numerous patents. General references to these dyes include *The Chemistry of Synthetic Dyes*, K. Venkataraman ed., Academic Press, Vol. 4 (1971) and *The Theory of the Photographic Process*, T. H. James, ed., MacMillian, Editions 3 and 4.

(2) Merocyanine dyes of the general formula:

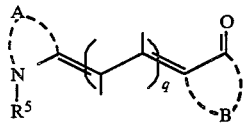

in which:

q is an integer of 0 to 2, $R^5$ and A are as defined above, and

B is as defined above or may complete a carbocyclic ring.

These dyes are also well known in the silver halide photographic art and are described in *The Theory of the Photographic Process*, referred to above.

(3) Oxonols of the general formula:

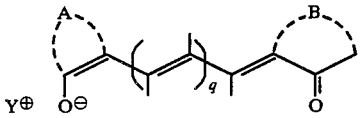

in which:

q is an integer of 0 to 2,

A and B may be the same or different and are as defined above in relation to cyanine and merocyanine dyes, and $Y^{\oplus}$ represents a cation.

Oxonol dyes are similarly well known in the silver halide photographic art and are disclosed in the above mentioned reference, *The Theory of the Photographic Process*, J. Fabian and H. Hartman, Light Absorption of Organic Colourants, Springer Verlag 1980 and U.S. Pat. No. 2,611,696.

Anionic bleachable dyes, of which oxonol dyes are a class, are particularly useful because of their ability to associate closely with the iodonium cations. Anionic dyes in general will possess a delocalised negative charge.

Anionic dyes may be regarded as being prepared from a central portion containing delocalisable electronic system and end units which allow stabilisation of the negative charge.

The central portion may generally be selected from molecules possessing two active aldehyde or aldehyde derived groups such as glutaconic aldehyde and its anil salts, 3-methyl glutaconic dialdehyde and its anil salts, and 3-anilinoacrolein and its anil salts. These central portions may react with end unit compounds containing active methylene groups such as malononitrile, $NC.CH_2COOR'$, where R' is an alkyl group containing from 1 to 6 carbon atoms, e.g. methyl, ethyl, propyl, butyl and hexyl groups, $R'SO_2CH_2CN$ and $R'SO_2CH_2.COR'$ in which R' is as defined above,

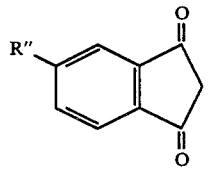

in which R'' is H or OH,

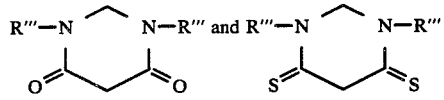

in which each R''' independently represent H or an alkyl group containing 1 to 6 carbon atoms.

The anionic dyes may have either the same end units or two different units.

It is to be understood that these cyanine, merocyanine, anionic and oxonol dyes may bear substituents along the polymethine chain composed of C, N, O and S, and that these substituents may themselves join to form 5, 6 or 7 membered rings, or may bond with rings A and B to form further rings, possibly with aromatic character. Rings A and B may also be substituted by C, N, H, O and S containing groups such as alkyl, substituted alkyl, alkoxy, amine (primary, secondary and tertiary), aryl (e.g. phenyl and substituted phenyl), halo, carboxyl, cyano, nitro, etc. Exemplary substituents are well known in the cyanine dye art.

(4) Benzylidene and cinnamylidene dyes of the structure:

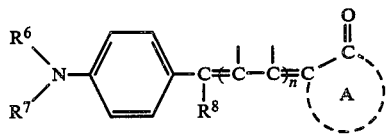

in which:

A is as defined above, and may additionally be cyano, or carboalkoxy or other carbonyl-containing groups, e.g. ketone, or S=O containing groups, e.g. $SO_2Me$, n is 0 or 1, $R^6$ and $R^7$ independently represent a hydrogen atom or an alkyl group (optionally substituted) or aryl group containing up to 12 carbon atoms, $R^8$ is H or CN or $CO_2R^9$, in which $R^9$ is an optionally substituted alkyl group of up to 6 carbon atoms, and the free valences may be satisfied by hydrogen or alkyl groups, or together may form a 6-membered carbocyclic saturated or aromatic ring.

Examples of such dyes include:

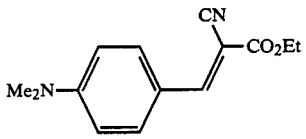

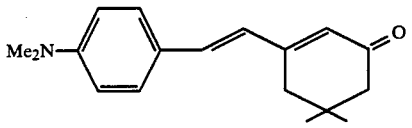

(5) Quinoline merocyanine dyes of the general structures:

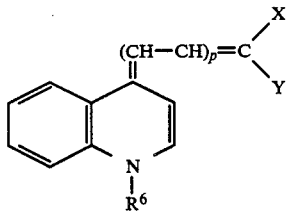

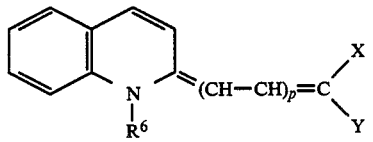

in which:

$R^6$ is as defined above, p1 is 0 or 1, and at least one of X and Y is an electron withdrawing group, e.g. cyano, nitro, carbonyl (in aldehyde, ketone, carboxylic acid, ester or amide), sulphonyl containing up to 6 atoms selected from C, N, O and S, or X and Y together form a 5 or 6 membered ring with additional atoms selected from C, N, O and S, and containing an electron withdrawing group (e.g. keta).

Examples of such dyes include:

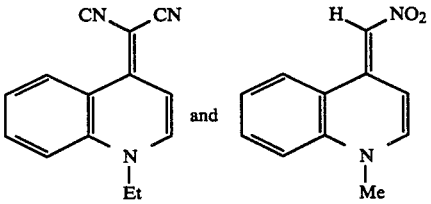

(6) Phenoazine dyes of the general structure:

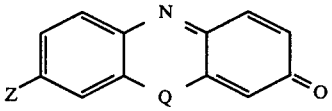

in which:

Z is an electron donor, e.g. $NR^6R^7$, in which $R^6$ and $R^7$ are as defined above, and Q represents O, S, NH, $NCH_3$, $NC_2H_5$, $CH_2$, e.g.

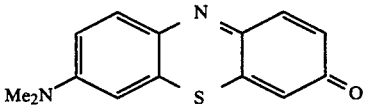

(7) Azamethine or indoaniline dyes of the general structure:

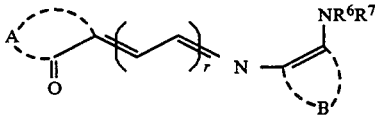

in which:

r is 0 or 1, and

A, B, $R^6$ and $R^7$ are as defined above.

The group $NR^6R^7$ may also be positioned in a para-disposition to the chain, in addition to the ortho-disposition shown. Simiarly the carbonyl group may be in other dispositions on the ring.

These dyes have been used in chromogenic photographic processes. Specific examples of such dyes include:

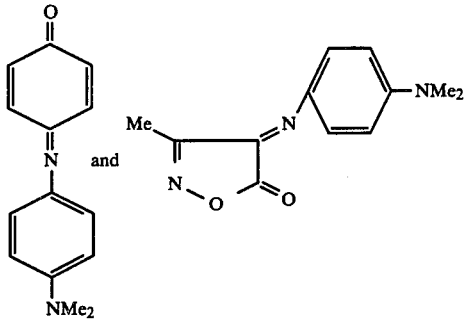

Other known classes of dyes useful in the diffusion transfer process which possess an activated methylene chain include bisquinones, bisnaphthoquinones, hemicyanine, streptocyanine, anthraquinone, indamine, indoaniline and indophenol.

Preferred dyes for use in the invention are anionic, more preferably oxonol dyes because (a) they give good sensitisation, believed to be due to an intimate reactive association between the negatively charged dye and the positively charged iodonium ion, (b) they are highly water/alcohol soluble, thus being readily separable from the iodonium ion, (c) readily mordanted to cationic polymer binders conventionally present in receptor layers (e.g. RD 173033-A39 G. A. Campbell) and (d) readily prepared affording a range of dyes with absorption in the region 350 to 700 nm.

Oxonol dyes which diffuse readily out of gelatin layers are known, e.g. Japanese Patent Specification No. 49099620, Fuji. The dyes have an oxidation potential between 0 and +1 volt, preferably between +0.2 and +0.8 V.

Examples of oxonol dyes include:

Yellow Dye 1

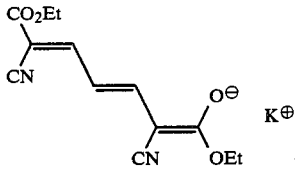

460 nm (EtOH)

Magenta Dye 1

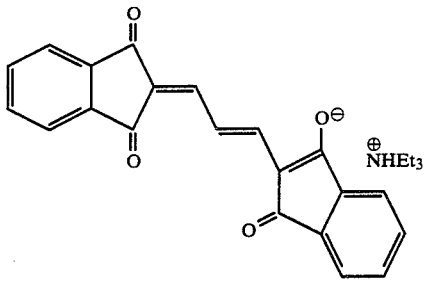

560 nm (EtOH)

Cyan Dye 1

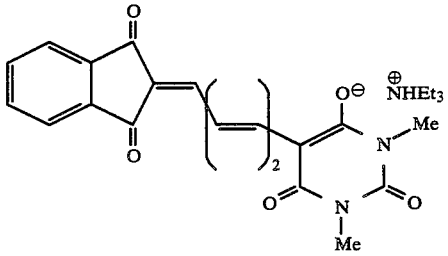

The cation of the oxonal dye need not be the iodonium ion and can be any cation including $Li^{\oplus}$, $Na^{\oplus}$ and $K^{\oplus}$ or quaternary ammonium cations, e.g. pyridinium or as represented by the formula:

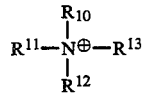

in which $R^{10}$ to $R^{13}$ may be selected from a wide range of groups including hydrogen, alkyl, preferably of 1 to 4 carbon atoms, aryl, e.g. phenyl, aralkyl of up to 12 carbon atoms. Preferably at least one of $R^{10}$ to $R^{13}$ is hydrogen and the rest are alkyl or aralkyl since such amines are readily available and allow easy synthesis of the dyes.

The iodonium ions used in the invention are compounds consisting of a cation wherein a positively charged iodine atom bears two covalently bonded carbon atoms, and any anion. The preferred compounds are diaryl, aryl/heteroaryl or diheteroaryl iodonium salts in which the carbon-iodine bonds are from aryl or heteroaryl groups and one of the aryl or heteroaryl groups is substituted with an alkyloxy group. Suitable iodonium salts may be represented by the formula:

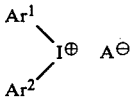

in which:

$Ar^1$ and $Ar^2$ independently represent carbocyclic or heterocyclic aromatic-type groups generally having from 4 to 20 carbon atoms, or together with the iodine atom complete a heterocyclic aromatic ring.

These groups include substituted and unsubstituted aromatic hydrocarbon rings, e.g. phenyl or naphthyl, which may be substituted with alkyl groups, e.g. methyl, alkoxy groups, e.g. methoxy, chlorine, bromine, iodine, fluorine, carboxy, cyano or nitro groups or any combination thereof. Examples of hetero-aromatic groups include thienyl, furanyl and pyrazolyl which may be substituted with similar substituents as described above. Condensed aromatic/hetero-aromatic groups, e.g. 3-indolinyl, may also be present, $A^{\ominus}$ represents an anion which may be incorporated into $Ar^1$ or $Ar^2$.

Preferably $Ar^1$ and $Ar^2$ do not have more than two substituents at the alpha-positions of the aryl groups. Most preferably $Ar^1$ and $Ar^2$ are both phenyl groups.

Preferred iodonium salts for use in the diffusion transfer process incorporate a ballasting group to prevent transfer of the iodonium ion during the dye diffusion transfer step. Suitable ballasting groups may be present on $Ar^1$ and/or $Ar^2$, preferably in the para-position with respect to the $I^{61}$ link, and are of the formula:

$$-OR^{14}$$

in which $R^{14}$ represents a straight chain or branched alkyl or alkyl substituted with OH, $OR^{15}$, $(NR^{16}{}_3)^{\oplus}$ in which $R^{15}$ and $R^{16}$ represent alkyl groups or a group having a quaternary group at the end of an alkyl chain, e.g. $CH_2—CH_2—CH_2N^{\oplus}Me_3X^{\ominus}$. $R^{14}$ should preferably have at least 3 carbon atoms and generally not more than 20 carbon atoms.

The presence of the $OR^{14}$ ensures transference of $Ar^2—OR^{14}$ to the bleached dye, thus resulting in immobilisation of the bleach product and low Dmin values.

The alpha-positions of the $Ar^1$ and $Ar^2$ groups may be linked together to include the iodine atom within a ring structure, e.g.

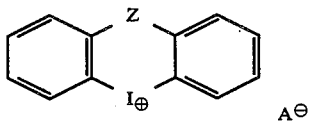

in which Z is an oxygen or sulphur atom. An example of such an iodonium salt is:

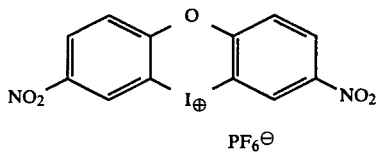

Other suitable iodonium salts include polymers containing the unit:

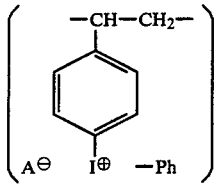

in which Ph represents phenyl.

Examples of such polymers are disclosed in Yamada and Okowara, *Makromol. Chemie*, 1972, 152, 61–6.

Any anion may be used as the counter-ion $A^{\ominus}$ provided that the anion does not react with the iodonium cation under ambient temperatures. Suitable inorganic anions include halide anions, $HSO_4^{\ominus}$, and halogen-containing complex anions, e.g. tetrafluoroborate, hexafluorophosphate, hexafluoroarsenate and hexafluoroantimonate. Suitable organic anions include those of the formulae:

$R^{17}COO^{63}$ or $R^{17}SO_3^{\ominus}$ in which $R^{17}$ is an alkyl or aryl group of up to 20 carbon atoms, e.g. a phenyl group, either of which may be substituted. Examples of such anions include $CH_3COO^{\ominus}$ and $CF_3COO^{\ominus}$.

$A^{\ominus}$ may be present in $Ar^1$ or $Ar^2$, e.g.

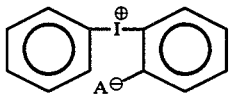

in which $A^{\ominus}$ represents $COO^{\ominus}$, etc.

Furthermore, $A^{\ominus}$ may be present in a molecule containing two or more anions, e.g. dicarboxylates containing more than 4 carbon atoms.

The most significant contribution of the anion is its effect upon the solubility of the iodonium salt in different solvents or binders.

Most of the iodonium salts are known, they may be readily prepared and some are commercially available. The synthesis of suitable iodonium salts is disclosed in F. M. Beringer et al, Journal of the American Chemical Society, 80, 4279 (1958).

Suitable substrates for the donor (or carrier) for use in both diffusion and sublimation transfer are plastics film, paper (cellulosic or synthetic fibre), metallised plastics film and plastic film to film or plastic film to paper laminates.

The substrate should be unaffected by the processing conditions. For example, the substrate must possess adequate wet-strength and dimensional stability for use in diffusion transfer. Similarly, a substrate for use in sublimation transfer must be heat-stable and not possess undesirable dimensional radiation, nor degradation, nor tackiness when subjected to the sublimation conditions. A preferred substrate is a plastics film such as polycarbonate film, cellulose acetate film or most preferably polyester, e.g. poly(ethyleneterephthalate), which may be biaxially orientated.

The substrates may possess surface modifying or other coatings to enhance adhesion of imaging layers, to improve smoothness, etc. Resin coated photographic grade paper is a suitable substrate. The plastics film may specifically possess a subbing layer which acts as a priming layer for gelatin and other hydrophilic coating.

Elements for use in the diffusion transfer process may comprise mixtures of dyes and iodonium salts dissolved in gelatin or oil-dispersed in gelatin, which, after image formation by visible light irradiation, are fixed by dye diffusion transfer to a gelatin and mordant-coated receptor sheet, which may contain dye stabilisers. The iodonium salt and dye are coated with a polymeric binder layer on a substrate.

The quantity of the dye relative to the iodonium salt is within the range of 1 to 50 weight percent. The quantity of iodonium salt plus dye in the coated layer falls within the range of 5 to 60%, assuming the remainder to be binder.

The polymeric binders are generally waterswellable of natural or synthetic origin, such as gelatin, gum arabic, poly(vinyl alcohol), poly(vinyl pyrrolidone). The polymers may contain cross-linking or other insolubilisation additives or may themselves be self-crosslinked to reduce solubility in the diffusion transfer processing solution while still maintaining diffusibility of the dye or dyes. Preferred in the invention is gelatin which is crosslinked via its lysine groups with carbonyl compounds (e.g. glyoxal, glutaraldehyde). The binder must allow the diffusion transfer solvent to enter the imaged layer and thus allow diffusion of the unbleached dye or dyes to the receptor sheet. If more than one dye is to be transferred a general equivalence of diffusion ratios is desirable.

A preferred dye, iodonium, polymer system for use in a diffusion transfer element is oxonol, diaryliodonium trifluoroacetate and gelatin, since the sensitive components are very soluble in gelatin.

The radiation-sensitive element may have single layer, multi-dye formulation or multi-layer, single dye per layer composites. Preferred elements should have less than 10 micron dye layer thickness to allow rapid dye diffusion. Thicker coatings result in long diffusion transfer times (e.g. 30 micron, 5 minutes for a transferred density of 2.5 reflected).

The receptor material is generally a sheet material to which the dyes are transferred during the diffusion process. Although the dyes may be transferred to untreated plastics film, paper (of cellulosic or synthetic fibre) or other receptive substrate material, it is normal for these to have surface modifying treatments.

The receptor substrate is generally selected from plastics film, paper (as above), metallised plastics film, and plastics film-to-film or film-to-paper laminates. These may be treated with surface modifying coatings to alter opacity, reflectivity, smoothness, adhesion of subsequent coatings, tint and dye absorptivity. Preferably the substrate is a plastics film such as biaxially oriented poly(ethylene terephthalate). Vesicular substrates, e.g. vesicular polyester, may be employed. The substrate preferably bears on an outer surface a polymeric coating which is swellable under the diffusion transfer conditions, e.g. gelatin cross-linked with metal ions such as $Cr^{+++}$ or $Ni^{++}$.

Additionally, it is highly desirable for a mordanting agent to be present in the receptor layer to prevent further diffusion of the dye thus serving to maintain resolution. The mordanting agent is normally electrically charged polymer, bearing opposite charge to the dye being transferred. Thus, a polyanionic polymer would be used for positively charged cyanine dyes. Cationic mordants are most preferred as they will render substantive oxonol dyes and will not mordant unreacted iodonium ion. The use of anionic, e.g. oxonol dyes, is therefore highly advantageous for the above reasons and additionally because of the enhanced reactivity which these dyes exhibit on exposure with iodonium ions. Charged metallic ions such as $Cr^{3+}$ and $Ni^{2+}$ may also be employed to effect mordanting, as may conventional mordanting agents. Examples of cationic mordanting polymers are:

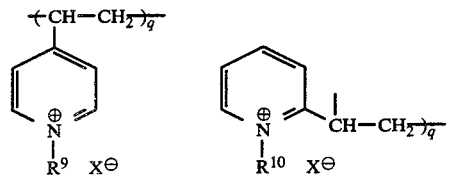

in which:

q is an integer, and $R^9$ and $R^{10}$ are as defined above.

Integral constructions incorporating both the imageable layer and the receptor layer in a single construction for diffusion transfer offer certain advantages in processing ease, in that there is no separate receptor construction. Integral constructions consist essentially of a transparent substrate bearing an imageable layer containing one or more bleachable dyes in reactive association with an iodonium ion and a receptor layer.

The substrate material is a transparent plastics film which is stable to diffusion transfer processing. A preferred substrate is biaxially orientated poly(ethylene terephthalate) film. This may bear transparent priming or subbing layers.

The components of the imageable layer have been previously described. The bleachable dyes may be present in one or more layers.

The receptor layer normally contains a mordanting aid for the dye such as a poly(4-vinyl pyridinium) polymer. Cationic polymers are preferred as they will not mordant any diffusing iodonium ion which may be subsequently washed out. Relative to the viewing surface of the final image, it may be necessary to include a backing layer containing a white or coloured pigment in order to provide a suitable reflective background. This reflective layer preferably contains a white pigment, most preferably baryta or titanium dioxide. The reflective layer must allow diffusion of the bleachable dyes and thus diffusion transfer processing solution permeable binders are required. Preferably, water swellable binders such as gelatin will be used for aqueous processing solutions. The reflective layer may exhibit mordanting properties or may contain a mordanting agent, although preferably the mordanting agent is in a separate layer.

Antihalation layers situated between the imageable layer and the reflective layer may also be incorporated. Again this antihalation layer must allow diffusion of the dyes. Carbon black dispersed in gelatin is a suitable composition for use with reflective coatings. An example of an integral construction for use in making a final image which is to be viewed by reflection is:

(a) a transparent substrate, e.g. biaxially orientated polyester film bearing a subbing layer,
(b) a mordanting layer, e.g. poly(4-vinyl pyridinium) polymer,
(c) a reflective layer, e.g. titanium dioxide in gelatin,
(d) an antihalation layer, e.g. carbon black in gelatin,
(e) one or more imageable layers (donor layers),
(f) optional transparent protective coating of a diffusion transfer liquid permeable binder, e.g. gelatin coated at 0.5 micron wet thickness.

In use the imageable donor layer is exposed in the normal manner. Thereafter the exposed composite is contacted with the diffusion transfer liquid for a sufficient time to allow penetration of the diffusion transfer liquid through the outer layers to the receiving layers. Unreacted dye diffuses from the donor layer through the antihalation layer, through the reflective layer and is rendered substantive in the mordanting coating. The final image may be viewed through the transparent substrate and will naturally possess a white background.

An alternative preferred construction employs layers (b) to (e) in reverse order. After exposure through the transparent base, the diffusion transfer liquid is applied and this allows the dye(s) to migrate back towards the mordanting layer. Evaporation of the diffusion transfer liquid may aid this process. The final image is viewed on a white background. A further construction is as above but omitting layers (c) and (d). Layers (b) and (e) may be in that position or reversed.

After exposure and diffusion transfer processing a final image suitable for projection viewing is obtained.

With the integral construction the diffusion transfer solvent may be applied by wiping, spraying, soaking, or by rollers, etc., optionally within a processing bath. Transfer of the dyes is effected rapidly, typically 30 to 60 seconds.

While diffusion transfer is normally effected at ambient temperature, elevated temperatures, e.g. 30° C., may also be employed.

In order to control the rates of diffusion of the dyes, which may have importance when full colour images are being formed, diffusion controlling layers may be included between the mordanting layer and the imaging layer and occasionally between individual dye layers.

An optional washing stage may be undertaken with the transferred image to remove residual iodonium ions. Water washing for a short period, e.g. one minute, may be beneficial although in normal practice this will not be necessary.

In order to achieve diffusion transfer the exposed donor sheet is rendered in close contact with the receptor layer, with the dye donor and dye receptor layers contacting. Transfer is achieved through the presence of the diffusion transfer liquid between the donor and receptor layers. It is essential that contact be maintained evenly and for a sufficient time to allow transfer to occur.

The diffusion transfer liquid may be applied in a variety of manners, such as (a) passing the donor and receptor sheet in face-to-face disposition through an automatic processing bath containing diffusion transfer fluid, excess fluid being expelled when the sheets emerge through the exit rollers, (b) releasing the diffusion transfer liquid from a pod and arranging this liquid to wet the donor and receptor layers, and (c) wiping or spraying or otherwise wetting either the donor or the receptor with diffusion transfer liquid and then quickly bringing the other in face to face contact, thereafter removing excess while keeping the faces in intimate contact.

In all the above instances the donor and receptor are kept in face-to-face contact for sufficient time for transfer to occur; thereafter the sheets are separated to reveal the high quality transferred image.

The process solution is normally colourless and may contain water and invisible solvents which evaporate shortly after the layers are separated.

The process solution preferably consists of aqueous alcohol (30 to 80%), with low molecular weight alcohols being preferred, leading to readily dried materials. The process solution may be buffered in the region pH 5 to 8, and contain antioxidants such as ascorbic acid/-sodium ascorbate to destroy any mobilised iodonium salt, or other additives.

In certain instances small quantities of iodonium salts may also migrate in which case it is desirable to wash the receptor layer with solvent such as water, to remove the iodonium salts. Generally, it has been found that the dye is the major transferring species.

Alternatively to solubilising the dye in the binder it may be desirable to add an oil, water-immiscible, phase to the binder and allow the dye and iodonium salt to react primarily within a finely dispersed oil droplet. After exposure such a layer is processed with the diffusion transfer solvent which allows the unreacted dye to migrate towards the receptor layer.

Binders suitable for use in preparing the carrier element for use in sublimation transfer are organic binders which dissolve readily in solvent and afford on coating clear dispersions of the dyes and iodonium salts described herein. Suitable binders include poly(vinyl butyral), poly(vinyl acetate) polymers and phenolic resins. The preferred weight range of iodonium ion to binder is from 3 to 15%. The preferred weight range of dye to iodonium salt is 1:1 to 1:15, more preferably 1:1 to 1:5.

The binder must allow the dyes to migrate on heating to the processing temperature, thus allowing transfer to the receptor layer. If more than one dye is present, a general equivalence of sublimation transfer rates is desirable.

A layer containing the above components is coated preferably at 30 to 60 g/m$^2$, wet deposition onto the substrate. It is undesirable to have overlayers as this hinders sublimation of the dyes, unless the overlayer is very thin. It is also preferred for all the bleachable dyes and iodonium salts present in an element to be in a single layer. Generally the element should be constructed so as not to inhibit the ready sublimation transfer of the dye from the carrier sheet. The topmost surface of the element should allow good contact with the receptor layer and not become tacky on heating to the transfer temperature.

The carrier element is firstly exposed so as to cause bleaching of the dyes by reaction with the iodonium ion. Most frequently visible light will be used, the actinic wavelengths corresponding to the absorption characteristics of the dyes. A variety of light sources may be used including continuous white light and laser. Sufficient exposure must be given to ensure full bleaching or decomposition of the dyes, as residual, unreacted dye may transfer. Thereafter the exposed precursor element is used to effect transfer of the unreacted dyes. Exposure is normally undertaken at ambient conditions of temperature although mild heating is allowable generally up to about 80° C., provided that this does not cause sublimation.

On light exposure the dyes react with the iodonium ions to give non-sublimable, charged species. The dyes reported in Table 1 are believed to react on exposure with iodonium salts to give charged photo-products of the general structure as follows:

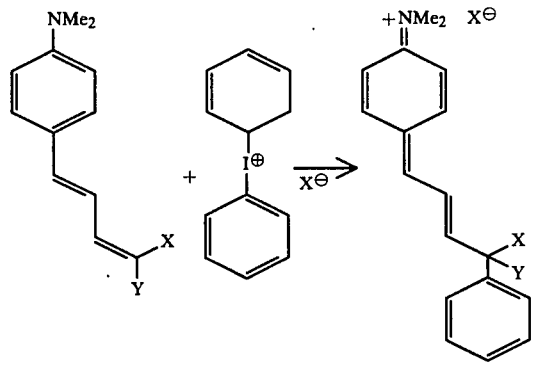

The reaction products do not significantly transfer on heating. After imaging at room temperature, the unbleached dye is readily separated by thermal transfer. Thus, the unbleached dye is transferred by sublimation to the receptor, and the iodonium salt and the dye photoproduct remain substantially in the imaging layer.

While the main purpose of this invention is to achieve visible dye transfer, organic ultraviolet and infrared absorbing molecules may also be transferred, e.g. to make ultraviolet or infrared masks.

The receptor material may be selected from a wide range of materials as described above including paper, particularly coated paper, e.g. poly(vinyl chloride) coated paper, plastics film materials, e.g. polyester, such as poly(ethylene terephthalate) films, including metallised films, woven and non-woven materials such as textile fabric and cloth and plastics paper.

The precursor and receptor should be capable of conforming together to allow transfer. The receptor material should absorb the transferred dyes for permanence and may be coated with absorbing pigments, mordants and organic polymers to improve dye absorption and stability. The receptor should withstand the transfer conditions and not exhibit adverse loss of dimensional stability or tackiness.

Typical processing times are from 30 to 120 seconds, with heating from 100° to 150° C. Thereafter the receptor is separated giving a single or multiple (e.g. full) colour reproduction. Heat may be applied through conduction or convection, contact with a heated roller, drum, platen or other surface, or in an oven or by an electrically heated layer or underlayer.

The short processing time and dry conditions are particularly useful aspects of this invention. The choice of receptor substrates is large and the transfer leaves behind various species which contribute to background fog levels. The backgrounds on the receptors are much cleaner (e.g. low Dmin) and there is a reduced tendency for the dye to degrade, being removed from the proximity of iodonium ions.

Dyes transferred to a receptor substrate may be further transferred from the receptor to yet another receptor. Here if the transfer is to be effected again, the first receptor should readily release the dyes again on heating. Multiple transfers of this kind will generally be accompanied by some loss in resolution and optical density. Single transfer results in a reversed-reading image. Double transfer results in a right-reading image.

Dyes may be transferred sequentially from separate substrates in order to achieve a multi-colour print, but generally it is desirable to transfer magenta, cyan and yellow dyes simultaneously from a single substrate if a full-colour print is required.

Once transferred the dyes may be viewed by reflection, as on paper, or by transmission. In general, only the unreacted dyes are transferred, however it is permissable for sublimable colourless stabilising additives to be transferred. Preferably such additives are incorporated in the surface of the receptor. Additives allowing maintenance of colour density are particularly useful.

The invention will now be illustrated by the following Examples.

In the following Examples the sensitivity of the element was measured by the following technique. A 2.5 cm square piece of each sample was exposed over an area of 2.5 $mm^2$ with focussed light filtered, using a Kodak narrow band filter (551.4 nm: power output$=2.36\times10^{-3}$ $W/cm^2$) and the change in the transmission optical density with time was monitored using a Joyce Loebl Ltd. microdensitometer. A plot of transmission optical density versus time was made and the exposure time (t) for the optical density to fall from $D_{max}$ to ($D_{max-1}$) was determined. The energy required (E) was calculated as the exposure time (t)$\times$power output ($=2.36\times10^{-3}$ $W/cm^2$): this gives an indication of the sensitivity of the elements.

In all cases a significant reduction of background density was achieved after transfer which gave a much cleaner image. Typically the minimum density before transfer and after exposure was approximately 0.15, this reducing to approximately 0.05 or below after transfer.

EXAMPLE 1

Single Dye Diffusion to Receptor

Cyan Dye 2

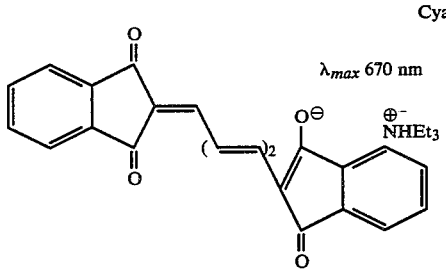

A solution of the Cyan Dye 2 (0.03 g) in ethanol (8 ml) and water (2 ml) was added in yellow light to gelatin (3.6 g) in water (30 ml) containing Tergitol TMN-10 (Union Carbide, 10% aqueous, 1.5 ml) at 45° C. Aqueous glyoxal (10%, 0.5 ml) and 4-methoxyphenyl phenyliodonium trifluoroacetate (2.0 g) dissolved in dimethylformamide (2.5 ml) were then added in the dark.

The mixture was loop-coated at approximately 20 micron dry thickness onto chilled, subbed polyester (4 mil) and dried at 25° C. in an air-circulated cupboard for one hour.

The density of the resulting film was 5.0 at 665 nm (transmitted). The density and time response of the film on irradiation at 670 nm with a light output of 2.5 $mW/cm^2$ was measured on a microdensitometer, giving a sensitivity of $4\times105$ $mJ/m^2$ for speed point of Dmax−1.

A strip was contacted with an UGRA scale (the UGRA scale was an 1976 UGRA-Gretag-Plate Control Wedge PCW) in a vacuum frame, emulsion to emulsion, and an exposure given of 60 s at 0.7 m from a 4 kW metal halide source (Philips HMP 17). The dyes from the resulting image were transferred to a vesicular polyester receptor substrate (75 micron). The substrate was coated with a gelatin receptor layer as follows.

A gelatin solution (3.6 g in 30 ml distilled water) at 40° C., containing poly(4-vinylpyridinium) methosulphate (0.04 g in 6 ml ethanol and 0.5 ml acetic acid), chrome alum (0.05 g), and nickel chloride (0.05 g) was loop-coated onto chilled subbed polyester (4 mil) and dried at 25° C. in an air circulated cupboard for one hour. The dried gelatin layer was about 30 micron thick, deposited at 0.4 $g/dm^2$. Ideally a less than 10 micron thick dry gelatin layer is preferred to achieve the benefit of better resolution.

The diffusion transfer was effected as follows: 1. The receptor was coated with the diffusion transfer process solution with K-Bar No. 6 (commercially available from R.K. Chemicals Ltd). on a coating bed. The process solution was made up of water (40 ml), ethanol (20 ml), sodium acetate (1.0 g), glacial acetic acid (2.0 ml).

2. The imaged donor was placed on top of the receptor, emulsion to emulsion, and the composite pressed together by the K-Bar to ensure that air bubbles were removed.

After 5 minutes contact the donor and receptor sheets were peeled apart, and the receptor given a 30 second water-wash to remove any small amount of the iodonium salt which also transferred.

The properties of the donor and receptor images are reported below.

The range of halftone dots retained on using a 120 lines per centimeter screen is also reported together with the resolution achieved.

| | Donor | Receptor |
|---|---|---|
| Resolution | 300 lines/mm | 83 lines/mm |
| Dot retention range | 4 to 96% | 4 to 96% |
| Dmax | 5.0 (Transmitted) | 2.6 (Reflected) |
| Dmin | 0.25/400 nm (Transmitted) | 0.09/400 nm (Reflected) |
| Contrast | −3.0 | −4.0 |

There are no undercutting effects in the line patch target, showing that the diffusion transferred dyes travel to the receptor without significant lateral spread which would result in unsharp images.

EXAMPLE 2

Three dye, full-colour copying element

The following dyes were employed Yellow Dye 1, Magenta Dye 1 and Cyan Dye 2.

A solution of the yellow, magenta and cyan dyes (respectively 0.03 g, 0.025 g, 0.03 g) in ethanol (6 ml)

and water (3 ml) was added in yellow light to an aqueous gelatin solution (3.6 g in 30 ml water) at 40° C.

Aqueous Tergitol TMN-10 (Union Carbide, 10%, 2.0 ml) and glyoxal (30%, 0.5 ml) were added to the resulting solution and then 4-methoxyphenyl phenyliodonium trifluoroacetate (2.0 g) in dimethylformamide (2.5 ml) was added in the dark. The radiation-sensitive mixture was coated onto clear subbed polyester (4 mil) using a loop-coater at approximately 20 micron dry thickness.

After drying in an air cupboard for one hour at 25° C., the following tests were made using a microdensitometer and the appropriate narrow cut filters. The film was panchromatic in nature. The results in the following table were obtained by measuring the optical density at the wavelength of maximum absorbance of the dye. The dyes were transferred without exposure, as in Example 1, the transfer time again being 5 minutes. The receptor of Example 1 was employed.

| Dye | Initial Peak Density (Transmitted) | Transferred Peak Density (Reflected) | λmax (nm) | Energy Sensitivity Dmax-1 ($x10^5$ mJ/m$^2$) |
|---|---|---|---|---|
| Yellow 1 | 3.3 | 2.8 | 454 | a9 |
| Magenta 1 | 3.5 | 2.1 | 562 | b27 |
| Cyan 2 | 3.4 | 2.0 | 673 | c5 |

[a]Filter at 461.6 nm, output power 1.79 mW/cm$^2$
[b]Filter at 551.4 nm, output power 2.89 mW/cm$^2$
[c]Filter at 670.7 nm, output power 2.52 mW/cm$^2$

Colour Proofing Application

A sample of the above Example was exposed in the following manner, using half-tone colour separation positives. On top of the sample was placed the black colour separation positive (thus the black information is retained from the start). On top of this assembly was placed the appropriate colour separation positive and Wratten filter. White light exposure was given, e.g. from a metal halide lamp.

Exposure 1: Filter 47B (blue) and Yellow Colour Separation Positive (CSP)

Exposure 2: Filter 61 (green) and Magenta CSP

Exposure 3: Filter 29 (red) and Cyan CSP

Exposures were performed in a vacuum frame with a 4 kW metal halide source at a distance of 0.5 m.

The resulting half-tone, full-colour proof was fixed by dye diffusion transfer to a vesicular polyester receptor, coated with gelatin and poly(4-vinylpyridinium) methosulphate as described in Example 1. A mirror image copy was obtained which retained the large range of 4 to 96% halftone dots (utilising a 120 lines per centimeter screen). There was no observable dot fill-in due to dye spread at the 96% dot level.

Colour proofing in this manner involves a total of four steps, compared to the twelve necessary in most conventional pre-press proofing materials, e.g. Dupont Cromalin and 3M Matchprint. The invention also has "on-line" potential, requiring only three exposures and one fixing step. This manner of exposure is known for dye forming reactions, as described in U.S. Pat. No. 3,598,583.

EXAMPLES 3 TO 5

Effect of iodonium salt on Dmin in receptor

| Iodonium Salts | Sensitivity ($\times 10^5$ mJ/m$^2$) | $D_{min}$ transferred |
|---|---|---|
| 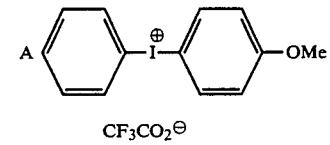 | 11 | 0.20 |
| 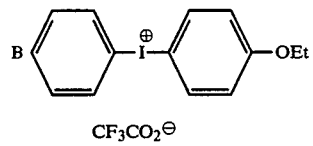 | 9 | 0.15 |
| 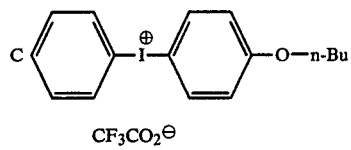 | 5 | 0.08 |

To a solution of Cyan Dye 2 (0.04 g) in ethanol (6 ml) and water (2.5 ml) in gelatin (3.6 g in 28 ml water) and Tergitol TMN-10 (10% aqueous, 1.5 ml) was added one of the above iodonium salts (0.5 g) in dimethylformamide (1.5 ml) in the dark. Glyoxal (30% aqueous solution 0.1 ml) was added and the mixture loop-coated onto subbed clear polyester (100 micron) and dried in air at 25° C. for one hour. A 30 micron dry layer resulted (0.4 g/dm$^2$ deposition).

The film was exposed as in Example 1 and dye transferred as in Example 1 to clear subbed polyester coated with gelatin and poly(4-vinyl pyridinium) methosulphate. The process solution used was made up as follows: water (40 ml), ethanol (20 ml), sodium acetate 1.0 g), acetic acid (2.0 ml), Tergitol TMN-10 (10% aqueous, 1.0 ml). After exposure and dye transfer as described in Example 1.

1. The Dmax in each case was measured as 3.8 in the donor and 1.5 in the receptor (transmittance).

2. The sensitivity at 670.7 nm was determined from density/time plots on a microdensitometer as previously described.

The sensitivity of the donor layer, the minimum (background) density on the receptor after transfer and the contrast value after transfer are recorded in the following table.

| Iodonium salt | Sensitivity ($x10^5$ mJ/m$^2$) | Dmin (400 nm) | Gamma (Contrast) |
|---|---|---|---|
| A | 11 | 0.20 | −3.5 |
| B | 9 | 0.15 | −4 |
| C | 5 | 0.08 | −4 |

The sensitivity of dye transferred to the receptor was also investigated. The density/time plot at 670 nm showed bleaching only for the first 5 seconds before levelling out to constant density. The maximum optical density dropped only by about 0.2 over this period. In the case of a 30 second water-wash after the diffusion transfer to remove trace iodonium salt, there was no such small initial loss of density.

The larger the alkyl group on the iodonium salt, the lower are the Dmin values at 400 nm. Thus, there can be immobilisation of the bleach product by transference of the alkoxyphenyl group from the iodonium ion to the dye. The iodonium salt would normally be selected to provide a low minimum density, e.g less than 0.1 or preferably much lower.

EXAMPLE 6

Process solution variation

A solution of 4-butoxyphenyl phenyliodonium trifluoroacetate (0.5 g) in DMF (2.0 ml) was added in the dark to a solution of Cyan Dye 2 (0.04 g) in gelatin (3.6 g), water (30 ml), ethanol (6 ml), and Tergitol TMN-10 (10% aqueous, 1.5 ml) at 45° C. Glyoxal was added (30% aqueous, 0.5 ml) and the mixture loop-coated as in Example 1 onto clear, subbed polyester in the dark. After drying in the dark in an air-circulated cupboard at 25° C. for one hour. One strip of film was exposed to a 250 W tungsten iodine source for 5 minutes. That strip were contacted with the receptor of Example 3. Dye transference was permitted in 5 minutes using Process Solutions A and B (Dmax). The maximum and minimum density on transfer was measured. Bleach product transference after 5 minutes using Process Solutions A and B was also measured by the minimum density figure. Iodonium ion transference, judged by any variation of the density/time plot at 670 nm, the maximum sensitivity peak of the dye was also measured.

The results are reported in the following Table.

| | |
|---|---|
| Processing Solution A | |
| water | 40 ml |
| ethanol | 20 ml |
| acetic acid | 1.0 g |
| sodium acetate | 2.0 g |
| Tergitol TMN-10 (10% aqueous) | 0.5 ml |
| Processing Solution B | |
| water | 40 ml |
| ethanol | 20 ml |
| ascorbic acid | 1.0 g |
| sodium isoascorbate | 3.0 g |
| Tergitol TMN-10 (10% aqueous) | 0.5 ml |

TABLE

Results after transference of dye using Solution A & B (5 mins/20° C.)

| Solution | Dmax[a] | Dmin[a] | Image density change |
|---|---|---|---|
| A | 1.0 | 0.05 | 0.1/5 secs[b] |
| B | 1.0 | 0.05 | No change |

[a]transmitted

[b]0.1 density drop in 5 seconds, stable subsequently.

Thus, with Solution B, there is essentially no transference of the iodonium salt to the receptor. The combination of a long-chain alkyl substituted iodonium salt and antioxidant anion (e.g. ascorbate) is preferred.

The process solution has the following functions:

1. it mobilises the dye from the donor to the receptor (too rapid movement is not required, as this will lead to loss of resolution).

2. it assists in immobilising the iodonium cation.

3. it contains stabilisers to give the dye light stability after transfer (e.g. antioxidants, oxygen energy quenchers).

4. it may also contain oxygen-barrier polymers (e.g. polyvinyl alcohol).

In the process Solution B, sodium isoascorbate performs two functions: (a) immobilises the iodonium cation, and (b) reacts with oxygen in the receptor layer leading to oxonol dye stability in the receptor.

EXAMPLE 7

An enlarged print of a 35 mm slide

The film of Example 2 was exposed to a 5× linearly expanded image from a 35 mm colour slide. The light source was a 250 W tin halide lamp. After 20 minutes exposure, the resulting copy was stabilised by contacting with a vesicular polyester receptor, coated as described in Example 2 with gelatin, poly(4-vinylpyridinium) methosulphate and chrome alum. Process Solution B was used from Example 1. After 5 minutes, the receptor was separated and 30 second water-washed, to give an enlarged copy of the colour slide.

EXAMPLE 8

Integral Donor/Receptor Construction

The following layers A to D were sequentially deposited using No. 6 K-bar (R.K. Chemicals Co.) onto 4 mil subbed polyester, with air-drying at 20° C. for 1 hour between each coating. Layers A to C were deposited in yellow light and layer D in the dark.

Layer A:

Poly(4-vinylpyridinium) methosulphate (0.2 g) and acetic acid (0.3 ml) was added at 45° C. to a gelatin solution (1 g in 10 ml water). Tergitol TMN-10 (10% aqueous, 0.3 ml) and chrome alum (0.05 g in 1 ml water) were then added, and the mixture coated and dried.

Layer B:

Titanium dioxide (1 g) was added at 45° C. to a gelatin solution (1 g in 10 ml water). The mixture was ultrasonically mixed for 0.5 hour to disperse the $TiO_2$ in the gelatin. Tergitol TMN-10 (10% aqueous, 0.3 ml) was added, followed by glyoxal (10%, 0.5 ml). The white solution was coated over layer A and dried.

Layer C:

0.5 ml Rotring ink (india black), Tergitol TMN-10 (10%, 0.3 ml) and glyoxal (10%, 0.5 ml) were added to a gelatin solution at 45° C. (1 g in 10 ml water). The black mixture was coated over layer B and dried. (At this point, one side of the polyester base appears black (layer C) and the other white (layer B)).

Layer D:

A mixture of oxonol dyes, Yellow Dye 1 (0.04 g), Magenta Dye 1 (0.04 g) and Cyan Dye 2 (0.05 g) in ethanol (2 ml), water (1 ml) and DMF (0.05 ml) was added at 45° C. to a 10% gelatin solution (10 ml). 4-Butoxyphenyl phenyliodonium trifluoroacetate (0.3 g in 1 ml DMF), Tergitol TMN-10 (10% aqueous, 0.6 ml) and glyoxal (10%, 0.5 ml) was added in the dark. The sensitive mixture was coated onto layer C and dried. (Note some yellow dye migrates to layer A and colours it yellow).

The dried composite film was imaged in contact with a colour transparency using a 250 watt xenon light (30 seconds at 10 cm). Application of the process solution described in Example 1 leads to transference of the dye from layer D to layer A in 10 minutes. A colour print results.

EXAMPLE 9

An oil dispersion coating to achieve improved sensitivity

A 10% gelatin solution at 45° C. was prepared to 10 ml. In the dark were mixed a solution of oxonol Cyan Dye 2 (0.03 g) in 0.2 ml di-n-butylphthalate and 1 ml butan-2-one and a solution of 4-butoxyphenyl phenyliodonium trifluoroacetate (0.2 g) in 1 ml butan-2-one. This sensitive mixture was added dropwise to the gelatin solution with vigorous stirring. After 90 seconds of vigorous agitation, Tergitol TMN-10 (10% aqueous, 0.3 ml) and glyoxal (10% aqueous, 0.3 ml) were added. The mixture was knife-coated at 3 mil wet thickness onto subbed polyester and dried in air at 20° C. for 1 hour. The film was analysed as follows:

1. The density at 670.7 nm was 4.5. The width at half-height of the dye absorption had increased to 70 nm from 45 nm in the non-dispersed coatings.
2. The sensitivity of the film was $2\times10^5$ mJ/m$^2$ measured at the dye peak, using a microdensitometer.
3. Application of the process solution described in Example 1 leads to a transference of 30% of the dye (as deduced by the transmitted density to the receptor after 5 minutes).

EXAMPLE 10

This Example shows the single sheet panchromatic capability of the invention.

A mixture of Dye No. 11 (0.06 g) and Dye No. 13 (0.06 g) in 3 ml EtOH was added to a lacquer of Butvar B76 (1 g) in 7 ml butan-2-one. To the red mixture in red light, was added diphenyliodonium hexafluoro- phosphate (0.3 g). The resulting lacquer was knife-edge coated at 75 micron, wet thickness onto unsubbed polyester base (100 micron). The film was dried for 15 minutes at room temperature in air.

A strip of this red film was subjected to a spot of light filtered through a narrow cut filter at 551.4 nm for 100 seconds; in the area of light, a yellow spot (5 mm diameter) formed. The imaged strip was then contacted with PVC coated paper and the composite heated for 2 minutes at 150° C. to transfer the dyes out of Butvar layer into the receptor. Good resolution was obtained; there was no spread of magenta into the imaged yellow spot.

EXAMPLE 11

Single dye sublimation transfer

Dye No. 11 (0.06 g) in 3 ml ethanol was added to Butvar 876 (1 g) in 7 ml butan-2-one. Diphenyliodonium hexafluorophosphate (0.3 g) was added to the resulting lacquer in red light. The mixture was coated at 75 micron thickness on unsubbed polyester base and dried at room temperature for 15 minutes in the dark. The following Table reports the initial and transferred maximum optical densities, Dmax, achieved.

A strip of the sample was imaged through a step wedge having an optical density differential between adjacent steps of 0.15, with a tungsten halide source (1 kW, 0.5 m) for 120 seconds. The resulting step image was contacted with a photographic, baryta paper receptor coated with poly(vinyl chloride) Bakelite Ltd., type VYNS, in the dark. The construction was covered with muslin and the composite heated with an iron set at "cotton" (temperature 150° C.) for 2 minutes. Separation of the construction gives a "mirror image" copy of the carrier film transferred onto the PVC coated paper. The following Table reports the reflected density after transfer. The minimum background density was found to be significantly less after the transfer process.

Resolution test

A strip of the sample was contacted with an UGRA mask (the UGRA mask was an 1976 UGRA-Gretag-Plate Control Wedge PCW) and this construction imaged as above using a tungsten halide source. In the carrier, the best resolution was 4 micron which is equivalent to 250 lines per milllimeter. The image was transferred to the PVC coated receptor by heating as above described. The best resolution was 17 micron which is equivalent to 59 lines per millimeter.

EXAMPLES 12 to 16

Example 11 was repeated using the dyes reported in the following Table, individually in the proportions indicated. The Table reports the maximum optical density by transmission achieved in the original and by reflectance in the receptor and the energy required at the $\lambda$max of the dye which gives a measure of the photosensitivity of the composition. A significant reduction in the minimum background density was observed after sublimation transfer.

TABLE

| Example No. | Dye No. | Structure | Weight g | $\lambda_{max}$ in ethanol nm | Density Ini | Density Tr | E ($\times 10^6$ mJ/m$^2$) |
|---|---|---|---|---|---|---|---|
| 11 | 11 | 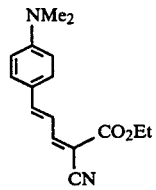 | 0.06 | 475 | 1.5 | 1.0 | 1.9 |
| 12 | 12 | 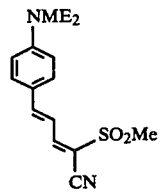 | 0.06 | 450 | 1.3 | 0.9 | 8 |
| 13 | 13 | 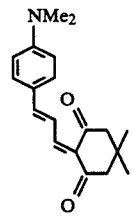 | 0.06 | 550 | 1.3 | 1.3 | 6.2 |
| 14 | 14 | 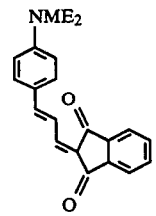 | 0.06 | 570 | 1.0 | 0.8 | 5.1 |

TABLE-continued

| Example No. | Dye No. | Structure | Weight g | $\lambda_{max}$ in ethanol nm | Density Ini | Density Tr | E ($\times 10^6$ mJ/m$^2$) |
|---|---|---|---|---|---|---|---|
| 15 | 15 | 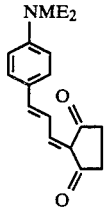 | 0.06 | 560 | 1.3 | 1.2 | 7.6 |
| 16 | 16 | 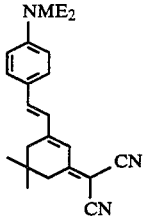 | 0.06 | 503 | 0.9 | 0.5 | 6 |

Ini = Initial density (transmission)
Tr = Transferred density (reflected) after heating 2 mins/150° C.

EXAMPLES 17 to 24

Photothermographic imaging with sublimation fixing

These Examples are for dyes which need light and heat simultaneously to react with iodonium salts.

The samples were coated in Butvar as in Example 11, but containing the dyes in the following Table, in the reported amounts. These dyes do not react with iodonium salts at room temperature, e.g. the change in the dye absorbance is zero after 5 minutes exposure to filtered light (2 mm$^2$ spot/1.7 mW/cm$^2$). On heating to above the Tg of the binder, e.g. 70° C. for Butvar B76, the light-induced reaction occurs. In some cases, there is an intermediate colour prior to bleaching.

In all cases a significant reduction in the minimum background optical density was observed.

TABLE

| Example No. | Dye No. | Structure | Weight g | $\lambda_{max}$ in a ethanol b Butane nm | Density Ini | Density Tr | E ($\times 10^6$ mJ/m$^2$) 25° C. | E ($\times 10^6$ mJ/m$^2$) 80° C. |
|---|---|---|---|---|---|---|---|---|
| 17 | 17 | 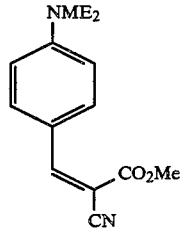 | 0.04 | 430 a | 3.0 | 1.8 | 400 | 9 |
| 18 | 18 | 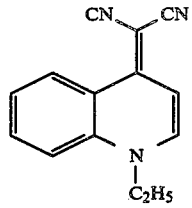 | 0.02 | 430 b | 1.2 | 0.8 | 90 | 0.7 |
| 19 | 19 | 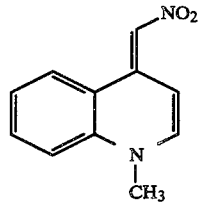 | 0.02 | 470 b | 0.9 | 0.4 | 100 | 9 |
| 20 | 20 | 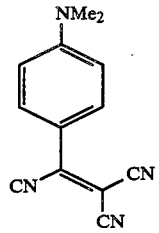 | 0.04 | 550 a | 0.5 | 0.6 | 100 | 80 |

TABLE-continued

| Example No. | Dye No. | Structure | Weight g | $\lambda_{max}$ in a ethanol b Butane nm | Density Ini | Density Tr | E ($\times 10^6$ mJ/m$^2$) 25° C. | E ($\times 10^6$ mJ/m$^2$) 80° C. |
|---|---|---|---|---|---|---|---|---|
| 21 | 21 | 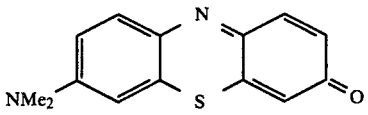 | 0.02 | 560 a<br>600 b | 0.6 | 0.7 | 50 | — |
| 22 | 22 | 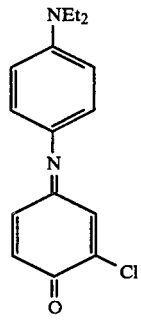 | 0.02 | 660 a | 0.5 | 0.6 | 100 | 1.3 |
| 23 | 23 | 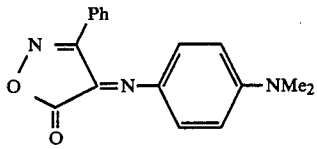 | 0.02 | 540 a | 0.9 | 0.2 | 100 | 9 |
| 24 | 24 | 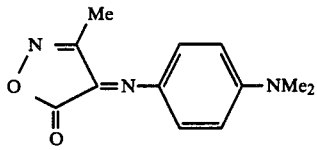 | 0.10 | 530 a | 1.8 | 1.2 | 100 | 1.8 |

Ini = Initial density (transmitted)
Tr = Transferred density (reflected) after heating 2 mins/150° C.

EXAMPLE 25

Light and heat imaging fixed by transfer

The blue coating of Example 22 was contacted with a black on white photocopy and the composite put through the 3M Thermofax Model 45CB processor at the "medium" setting. The result was a negative copy of the photocopy, bleaching had occurred in the regions in contact with the black characters. This copy was then stabilised by dye sublimation to a poly(vinyl chloride) coated paper receptor by heating for 30 seconds at 100° C. The result was a blue-coloured negative print of the original. A significant reduction in background density was observed on transfer.

We claim:

1. A process for forming an image which comprises image-wise exposing to radiation of selected wavelength a carrier element comprising, as image forming components, in one or more imaging layers coated on a support a bleachable dye in reactive association with iodonium ion thereby bleaching the dye in exposed areas to form a positive image, and thereafter transferring the positive dye image to a receptor which is either a receptor layer present on the carrier or a separate receptor element by (i) heating the carrier element to a sufficient temperature to allow the dye image to sublime to the receptor thereby forming an image on the receptor, or (ii) providing a liquid medium between the positive dye image and receptor for a sufficient time to allow transfer of the dye image to the receptor.

2. A process as claimed in claim 1, in which the iodonium compound has the general formula:

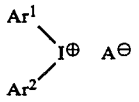

in which:

$Ar^1$ and $Ar^2$ independently represent carbocyclic or heterocyclic aromatic-type groups having 4 to 20 carbon atoms, or together with the iodine atom complete a heterocyclic aromatic ring, and $A^{\ominus}$ represents an anion which may be incorporated into $Ar^1$ or $Ar^2$.

3. A process as claimed in claim 2, in which at least one of $Ar^1$ and $Ar^2$ includes a substituent $$-OR^{14}$$

in which $R^{14}$ represents a straight chain or branched chain alkyl group of at least 3 carbon atoms, optionally substituted with one or more groups selected from OH, $OR^{15}$, $(NR^{16}{}_3)^{\oplus}$ in which $R^{15}$ and $R^{16}$ represent alkyl groups or a group having a quaternary group at the end of the alkyl chain.

4. The process of claim 1, in which the carrier element comprises cyan, magenta and yellow bleachable dyes, the element being constructed and arranged to allow even transfer of each dye.

5. The process of claim 1, in which the dye and iodonium salt are present in one or more layers in a polymeric binder, the weight ratio of dye to iodonium salt being in the range of from 1:1 to 1:50 and the binder is present in an amount from 50 to 98% by weight of the total weight of binder, dye and iodonium salt.

6. The process of claim 1, in which the bleachable dye is soluble in an aqueous diffusion transfer liquid and the process comprises providing an aqueous medium between the positive dye image and receptor for a sufficient time to allow transfer of the dye image to the receptor.

7. A process as claimed in claim 6, in which the bleachable dye is selected from a polymethine dye of the formula:

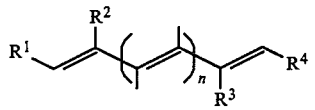

in which:

n is 0, 1 or 2, and $R^1$ to $R^4$ are selected to provide an electron donor moiety at one end of the conjugated chain and an electron acceptor moiety at the other, and independently represent halogen, cyano, nitro, carboxy, alkoxy, hydroxy, alkyl, aryl groups or heterocyclic rings any of which may be substituted, said groups containing up to 14 atoms selected from C, N, O and S; or $R^1$ and $R^2$ and/or $R^3$ and $R^4$ may represent the necessary atoms to complete optionally substituted aryl groups or heterocyclic rings, containing up to 14 atoms selected from C, N, O and S, or an oxonol dye of the formula:

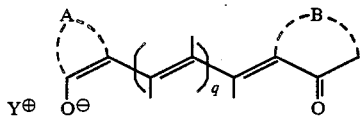

in which:

q is an integer of 0 to 2,

A and B independently represent alkyl, aryl or heterocyclic groups or the necessary atoms to complete heterocyclic rings which may be the same or different $Y^{\oplus}$ represents a cation.

8. A process as claimed in claim 6, in which the receptor comprises a layer having a polymeric binder and optionally a mordant.

9. A process as claimed in claim 6, in which the radiation-sensitive carrier element comprises a receptor layer separated from the imaging layer(s) by a layer containing carbon and/or titanium dioxide.

10. A process as claimed in claim 1, in which the bleachable dyes are sublimable within the temperature range from 100° to 150° C. and the process comprises placing the carrier element in contact with a receptor and heating to a temperature of 100° to 150° C. for a period of about 30 to 120 seconds to transfer the dye image from the carrier element to the receptor.

11. A process as claimed in claim 10, in which the bleachable dye is selected from (a) merocyanine dyes of the general formula:

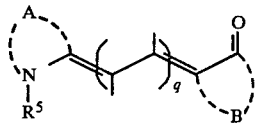

in which:

q is an integer of 0, 1 or 2, $R^5$ represents a hydrogen atom or substituents which may be present in conventional cyanine dyes, A represents an alkyl, aryl or heterocyclic group or the necessary atoms to complete a heterocyclic ring, and B is selected from the same groups as A or additionally may complete a carbocyclic ring, (b) benzylidene and cinnamylidene dyes of the structure:

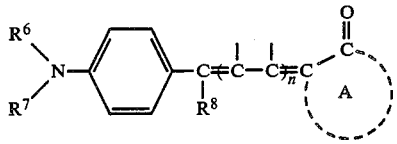

in which:

A is as defined above, and may additionally be cyano, carbonyl-containing groups of no more than 6 carbon atoms or S=O containing groups, n is 0 or 1, $R^6$ and $R^7$ independently represent a hydrogen atom or either substituted alkyl or unsubstituted alkyl group, or aryl group containing up to 12 carbon atoms, $R^8$ is H or CN or $CO_2R^9$, in which $R^9$ is an optionally substituted alkyl group of up to 6 carbon atoms, and the free valences may be satisfied by hydrogen or alkyl groups, or together may form a 6-membered carbocyclic saturated or aromatic ring, (c) quinoline merocyanine dyes of the general structures:

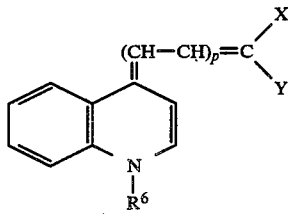

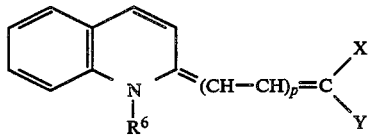

in which:

$R^6$ is as defined above, p2 is 0 or 1, and at least one of X and Y is an electron withdrawing group, sulphonyl containing up to 6 atoms selected from C, N, O and S, or X and Y together form a 5 or 6 membered ring with additional atoms selected from C, N, O and S, and containing an electron withdrawing group, (d) phenoazine dyes of the general structure:

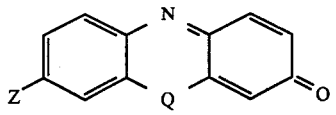

in which:

Z is an electron donor,

Q represents O, S, NH, $NCH_3$, $NC_2H_5$, $CH_2$, and (e) azamethine or indoaniline dyes of the general structure:

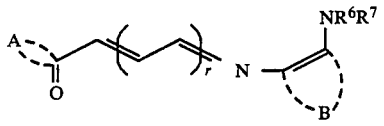

in which:

r is 0 or 1, and

A, B, $R^6$ and $R^7$ are as defined above, the $NR^6R^7$ and carbonyl group optionally being in other dispositions on the rings A and B.

12. A process as claimed in claim 11, in which the process comprises the additional step of placing the receptor in intimate contact with a final receptor and heating the composite for a sufficient time and to a sufficient temperature to allow the dye to sublime across the interface to the final receptor thereby forming a true image.

13. The combination of a radiation-sensitive carrier element comprising, as image-forming components, one or more imaging layers coated on a support, a bleachable dye in reactive association with iodonium ion and a separate receptor element comprising a substrate having coated thereon a receptor layer comprising a polymeric binder and optionally a mordant.

14. A radiation-sensitive element comprising, as image-forming components, one or more imaging layers coated on a support, a bleachable dye in reactive association with iodonium ion and a receptor layer comprising a polymeric binder and optionally a mordant.

15. An element as claimed in claim 14, in which the receptor layer is separated from the imaging layer(s) by a layer containing carbon and/or titanium dioxide.

* * * * *